United States Patent [19]

Wakefield

[11] 4,349,200

[45] Sep. 14, 1982

[54] GAS GUN FOR BALLISTIC TESTING

[75] Inventor: Felix R. Wakefield, Didcot, England

[73] Assignee: The Secretary of State for Defence in Her Britannic Majesty's Government of the United Kingdom of Great Britain and Northern Ireland, London, England

[21] Appl. No.: 172,886

[22] Filed: Jul. 28, 1980

[51] Int. Cl.[3] ..... A63B 65/12; F41F 1/04

[52] U.S. Cl. ..... 273/371; 73/12; 124/77; 137/614.19; 137/628; 251/309

[58] Field of Search ..... 124/59, 70, 71, 73, 124/74, 75, 76, 77; 91/454, 456, 459; 137/614.19, 628; 251/66, 309; 73/12, 167

[56] References Cited

U.S. PATENT DOCUMENTS

| | | | |
|---|---|---|---|
| 387,517 | 8/1888 | Jackson | 124/73 |
| 429,593 | 6/1890 | Bartlett | 124/73 X |
| 614,878 | 11/1898 | Mefford | 124/73 |
| 691,502 | 1/1902 | Sturges | 251/309 |
| 1,283,818 | 11/1918 | Laun | 137/628 X |
| 2,304,841 | 12/1942 | Mikkelsen | 124/73 |
| 2,307,443 | 1/1943 | Atkinson et al. | 251/309 |
| 2,492,873 | 12/1949 | Lamb | 137/614.19 X |
| 2,526,018 | 10/1950 | Foster et al. | 124/73 |
| 2,731,952 | 1/1956 | Szabo | 91/456 X |
| 2,998,719 | 9/1961 | Rubin | 73/167 X |
| 3,444,733 | 5/1969 | Curchack | 73/167 |
| 3,632,119 | 1/1972 | Carpenter | 251/309 X |
| 3,656,713 | 4/1972 | Walton | 251/309 |
| 3,915,143 | 10/1975 | Waller | 124/77 |

FOREIGN PATENT DOCUMENTS

| | | | |
|---|---|---|---|
| 1287478 | 8/1972 | United Kingdom | 73/12 |

*Primary Examiner*—Richard T. Stouffer
*Attorney, Agent, or Firm*—Pollock, Vande Sande & Priddy

[57] ABSTRACT

A gas gun has a charge chamber, an inlet valve to admit a charge of compressed gas to the charge chamber and either a plane or rifled barrel which communicates at its breech end with the charge chamber via a rotary outlet valve. Preferably the inlet valve is linked to the outlet valve so that closing of the inlet valve immediately precedes the opening of the outlet valve. The outlet rotary valve includes a frestoconical valve member which rotates within a complementary seat and has a radial bore which can connect two or more ports in the wall of the seat and is strongly biassed to the open position. The inlet and outlet valves may be combined in a three-way valve. In use a projectile is placed at the breech end of the barrel and the inlet valve is opened and the outlet valve closed. After compressed gas, preferably helium, has been introduced to the charge chamber to the desired pressure, the gun is fired by closing the inlet valve and immediately thereafter opening the outlet valve. The projectile expelled thereby has a velocity that is determined in part by the gas pressure in the charge chamber and may readily be varied by adjusting the gas pressure. Chamber pressures in the range 500 to 1500 psi lead to projectile velocities of the order 250–460 meter/second. The gas gun is especially useful in ballistic testing of, for example, personal armor.

13 Claims, 3 Drawing Figures

GAS GUN FOR BALLISTIC TESTING

This invention relates to a gas gun suitable for ballistic testing and especially the ballistic testing of protective clothing, such as goggles, helmets and jackets.

The conventional method of ballistic testing protective clothing has involved firing live ammunition into/at the clothing of interest. This process has a number of disadvantages. Firstly, a firing range is required, with the attendant hazards of handling and storing explosives. Secondly, in order to vary projectile velocities it is necessary to meter variable known amounts of propellant into cartridge cases, normally by hand. Thus, testing by means of live ammunition is an expensive, inconvenient and time-consuming operation.

It is known, for example in guns such as those described in U.K. Pat. Nos. 203,076 and 713,044, and in mortars such as those described in U.K. Pat. Nos. 525,065 and 552,055, to propel projectiles with compressed gas. However such conventional guns and mortars cannot achieve the very high velocities (generally hundreds or even thousands of meters per second) required for ballistic testing and do not provide facilities for accurately varying the gas pressure and hence projectile velocity.

It is also known, from U.S. Pat. Nos. 3,662,729 and 3,680,540 to propel baseballs and golfballs at known speeds from gun barrels with compressed gas. However, while the pressures in the charge chambers of the devices of U.S. Pat. Nos. 3,662,729 and 3,680,540 may be controlled, the pressures employed are respectively only about 10 psi and 200 psi. Thus the valves of these devices, via which the compressed gas is transferred from the charge chamber to the barrel, respectively butterfly or ball valve and piston valve, are designed to work at such pressures and are generally unsuitable for use in ballistic testing apparatus wherein the transfer valve must withstand pressures of up to 2000 psi or higher and still seal adequately but open quickly.

The aim of the present invention is to provide an apparatus for ballistic testing which fires projectiles at a wide range of projectile velocities, up to at least 500 m $sec^{-1}$, without many of the safety and other problems that are associated with the use of live ammunition.

Thus the present invention provides a gas gun comprising a charge chamber, an inlet valve to admit a charge of compressed gas to the charge chamber, a barrel to receive a projectile and, communicating at its breech end with said charge chamber via a rotary outlet valve.

Preferably the inlet valve is linked to said rotary outlet valve so that closing of the inlet valve immediately precedes the opening of the outlet valve. This may be achieved by electrical or mechanical interlocking or by combining the inlet and outlet valves in a single three-way valve. The inlet valve may be a rotary or other type of valve, for example a solenoid valve.

The term rotary valve as used herein refers to a valve of the type wherein a valve member rotates within a complementary seat and has a radial bore which can connect two or more ports in the wall of said seat. The valve member may be cylindrical or spheroidal or preferably frusto-conical. It has surprisingly been found that this type of valve is capable of transferring the compressed gas charge from the charge chamber to the barrel substantially instantaneously without significant pressure drop during opening. It is also capable of very rapid operation even when controlling very high gas pressures. This is believed, although the invention is in no way limited to this explanation, to be due to a "gas bearing" effect of the compressed gas on the valve member/seat interface.

The charge chamber may be manufactured from any material that is strong enough to withstand the maximum gas pressure to be contained within said chamber. When very high gas pressures (greater than about 1500 psi) are to be contained within the chamber, stainless steel is the preferred material, although other suitable metals or alloys could be used. If low gas pressures only are to be contained within the chamber then said chamber could comprise reinforced plastics material.

The barrel may comprise any material conventionally used in the art. Steel is the preferred material but any metal, alloy or reinforced plastics material of suitable strength may be used. The barrel bore may be plane or rifled. When the barrel is rifled a minimum gas chamber pressure, which is dependent on the depth of rifling in the barrel, is required to fire the projectile.

The rotary valve is preferably strongly biassed towards an open position by a suitable biassing means, for example, one or more springs. In this way, when the valve is to be closed, the valve member is rotated, out of coincidence with either or both of the chamber or barrel, by an actuating means, such as lever, against the action of the biassing means. The valve may be retained in the closed position manually or by conventional retaining means. When released, the valve will turn back automatically, under the influence of the biassing means, until the chamber and barrel are again brought into communication with each other.

The muzzle velocity of the projectile will depend on its acceleration within the barrel and on the length of the barrel within the limit of pressure times area being capable of overcoming resistance. The initial acceleration (A) is given by $$A = \frac{\Delta P \times a}{M}$$

wherein $\Delta P$ is the gas pressure measured as the excess over atmospheric (ie gauge pressure), a is the rear cross-section area of the projectile (and barrel) and M is the mass of the projectile.

Therefore, for a given weight of projectile and length of barrel the velocity will increase as either or both $\Delta P$ or a increases. In the present invention the projectiles employed generally have only small sectional areas (a) and this would lead to correspondingly low projectile accelerations and velocities. By housing the projectiles within sabots, a technique well known to those skilled in the art, the effective sectional areas of the projectiles are increased and so, under a given set of conditions, are their accelerations and velocities. However there is a theoretical limit velocity imposed by properties, notably elasticity, of the gas used. Thus for air the maximum practical velocity is 310 meter per second, whereas with more elastic gases, such as helium, velocities approaching 1000 meter per second should be possible. Inflammable or explosive gases should preferably be avoided. The actual gas pressure used will depend on the velocity required, and may, for example, vary from 100 to 2000 pounds per square inch (psi), but will typically be in the range 500 to 2000 psi (3.45 to 13.80 MN per square meter) for velocities of the order 250–530 meter per second. It follows that the charge chamber of this invention must comprise material suitable to withstand a gas pressure of between about 100 and 2000 psi, preferably of between about 500 and 2000 psi.

The physical dimensions of the gun are less critical, but should be arranged to minimize the pressure drop and hence loss of acceleration as the projectile accelerates along the barrel. Thus the volume of the charge chamber should be large compared with that of the barrel. Similarly the barrel should preferably be of sufficient length to allow the projectile to accelerate to an equilibrium velocity. Since the mass of the projectile increases as the cube of its linear dimension while the area acted on by the gas increases only as the square, increased projectile size (ie barrel bore) requires not only a large charge chamber but also a higher gas pressure for equal velocity. Hence the barrel bore should preferably be below about 10 mm for maximum efficiency.

Clearly some means of monitoring and preferably controlling the gas pressure in the charge chamber should be provided. The compressed gas may be supplied to the charge chamber by any conventional means, such as a cylinder or other reservoir of compressed gas, equipped with a pressure regulating and monitoring valve, or direct from a compressor provided with a cut-out to control the pressure reached.

The gas gun of this invention is particularly useful for the ballistic testing of objects designed to stop flying projectiles and especially of protective clothing. It is suitable for experimental ballistic testing of protective clothing, requiring projectiles to be fired at said clothing in a sequence with each shot higher in velocity than its predecessor. This steady gradation of projectile velocities can be readily achieved by the gas gun of this invention by ensuring that the chamber gas pressure for each shot is higher than the chamber pressure for the previous shot. Further the velocities (greater than about 300 m $sec^{-1}$) that are required for the ballistic testing of protective clothing are also readily attainable with this gas gun. It is, however, equally suitable for routine proof testing at constant velocity.

However the gas gun described herein is by no means limited in its use to the ballistic testing of objects by firing a projectile at a test object to ascertain the degree of penetration of said projectile into said object. Thus, the stability of the projectile itself could be tested. This could be achieved by firing the projectile, at a known velocity, at an impenetrable surface and measuring, by any suitable means, the damage caused to said projectile.

The gas gun of this invention and the method of ballistic testing of this invention will now be described by way of example only, with particular reference to the accompanying figures wherein.

Figure 1:
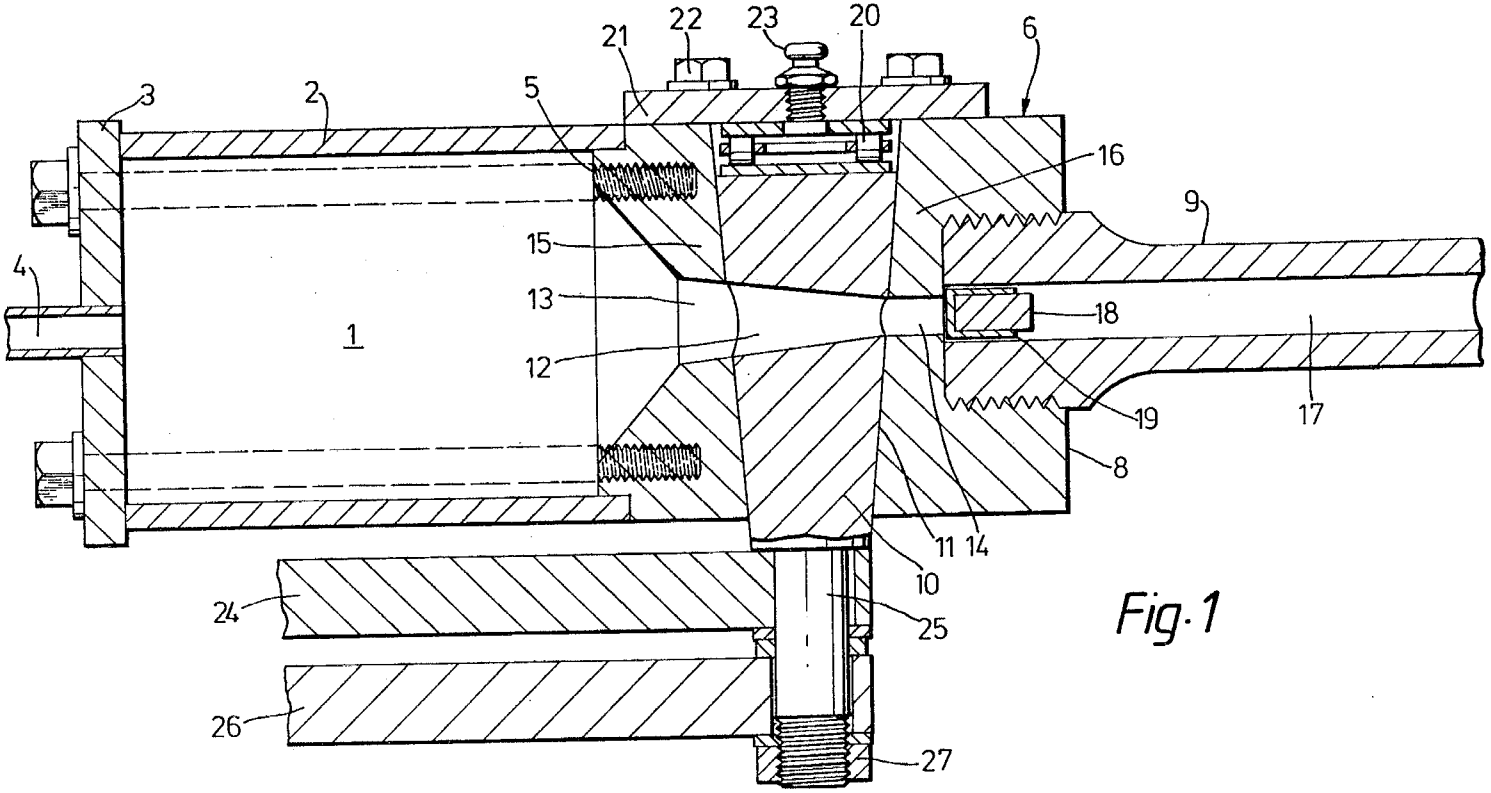
FIG. 1 is a longitudinal section of an embodiment of a gun according to this invention.

In FIG. 1 a cylindrical charge chamber 1 is formed from a steel side wall 2, a steel rear wall 3 bearing a gas inlet pipe 4 and the rear face 5 of a rotary valve 6. The side wall 2 of the charge chamber 1 is fixed to the rear wall 3 and the rotary valve 6 by a suitable fast setting sealing agent and by bolts 7 (dotted lines) that pass through the rear wall 3, along the outside of the side wall 2 and screw into the rear wall 5 of the rotary valve 6.

The forward face 8 of the rotary valve 6 has a threaded socket to receive a barrel 9. The rotary valve 6 has a frusto-conical valve member 10 that rotates within a complementary seat 11. The valve member 10 has a radial bore 12 which can connect two opposed ports 13, 14 in the opposed walls 15, 16 of the seat, opening into the charge chamber 1 and into the bore 17 of the barrel 9. Radial bore 12 is, as shown in FIG. 1, of tapered configuration and has a wide opening which complements port 13 in wall 15 of seat 11 disposed adjacent charge chamber 1, and a narrow opening that complements smaller port 14 in wall 16 of seat 11 disposed adjacent bore 17 of barrel 9. In use a projectile 18 housed in a sabot 19 is placed in the bore 17 of the barrel 9 and adjacent the valve port 14.

The valve member 19 is kept in close fitting arrangement with the complementary seat 11 by pressure applied to it through steel thrust bearing 20 by a pressure plate 21 secured by nuts 22. The amount of pressure applied to the valve member 10 can be varied by either tightening or loosening the nuts 22 and/or by placing shims between the rotary valve 6 and the pressure plate 21. The thrust bearings 20 are lubricated by passing lubricant through grease nipple 23.

The valve member 10 may be rotated by a firing arm 24 that is keyed at one end to a cylindrical extension 25 of the valve member 10. A cocking lever 26 is pivotally mounted on the cylindrical extension 25 beyond the firing lever 24 and secured by a nut 27.

Figure 2:
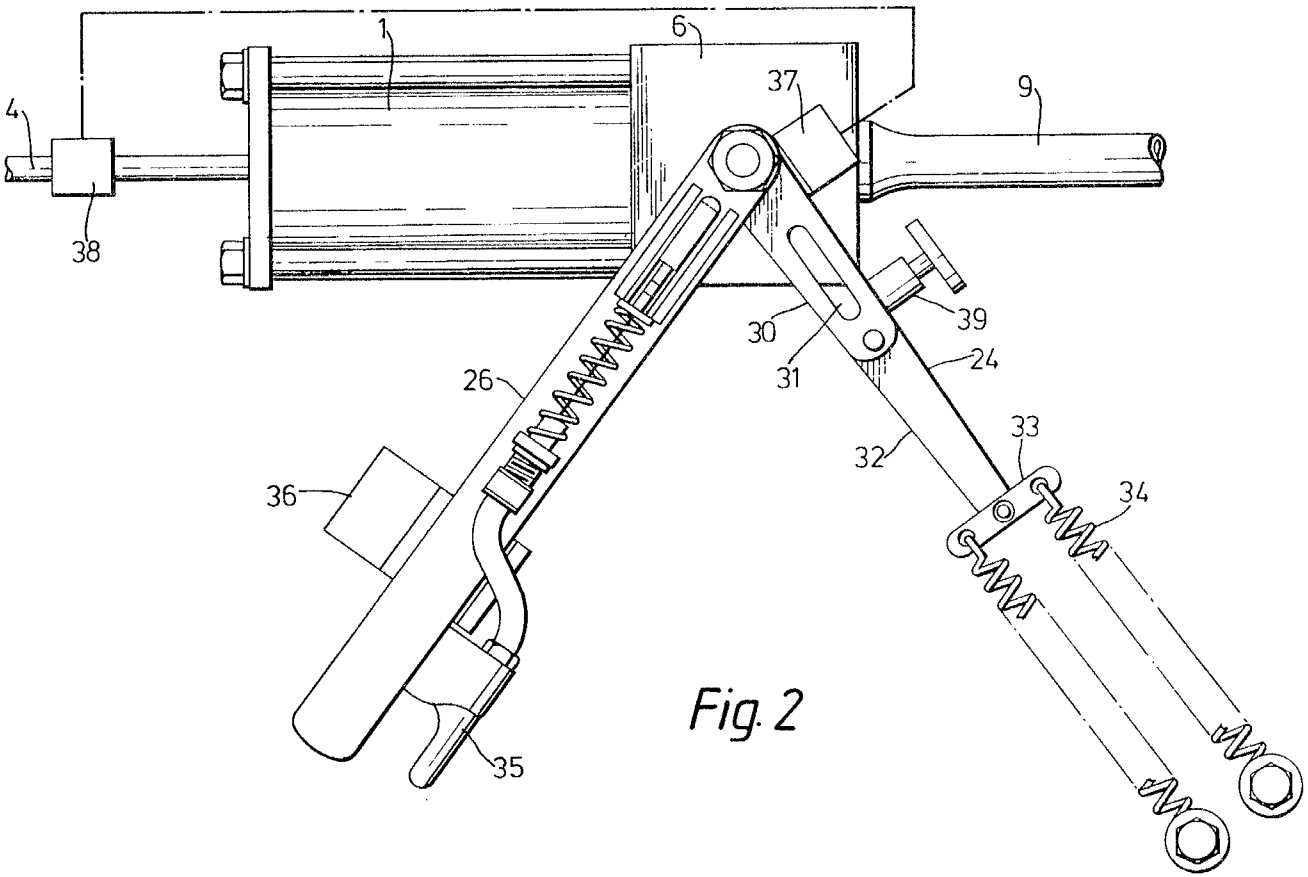
FIG. 2 shows the gun in side elevation.

FIG. 2 shows the charge chamber 1, rotary valve 6 and barrel 9. The firing arm 24 comprises an upper rotating section 30, that has an engaging slot 31 and is pivotally connected to a non-rotating part 32 in turn connected through transverse steel member 33 to springs 34 biassing the valve member towards the open position. The cocking lever 26 is provided on its underside with a metal spine, biassed to engage in the engaging slot 31 of the firing lever 24 and releasable therefrom by a trigger mechanism 35. Thus the rotary valve 6 may be closed by engaging the cocking lever 26 with the firing lever 24 and rotating the firing lever 24 against the bias of the spring 34. The two levers can be retained in this cocking position, wherein the springs 34 are in tension, by placing the cocking lever 26 behind a holding member 36.

A microswitch 37 is activated by the firing arm 24 in its extreme cocking position to open a solenoid valve 38 on the gas inlet pipe 4. When the firing arm 24 is released from this extreme position the microswitch 37 closes the solenoid valve 38. In this way the charge chamber 1 is isolated from the gas source immediately prior to the opening of the valve member in the rotary valve 6 as the firing arm 24 returns to its normal biassed position.

The firing arm 24 is restrained from passing its normal biassed position by an impact absorbing member 39.

Figure 3:
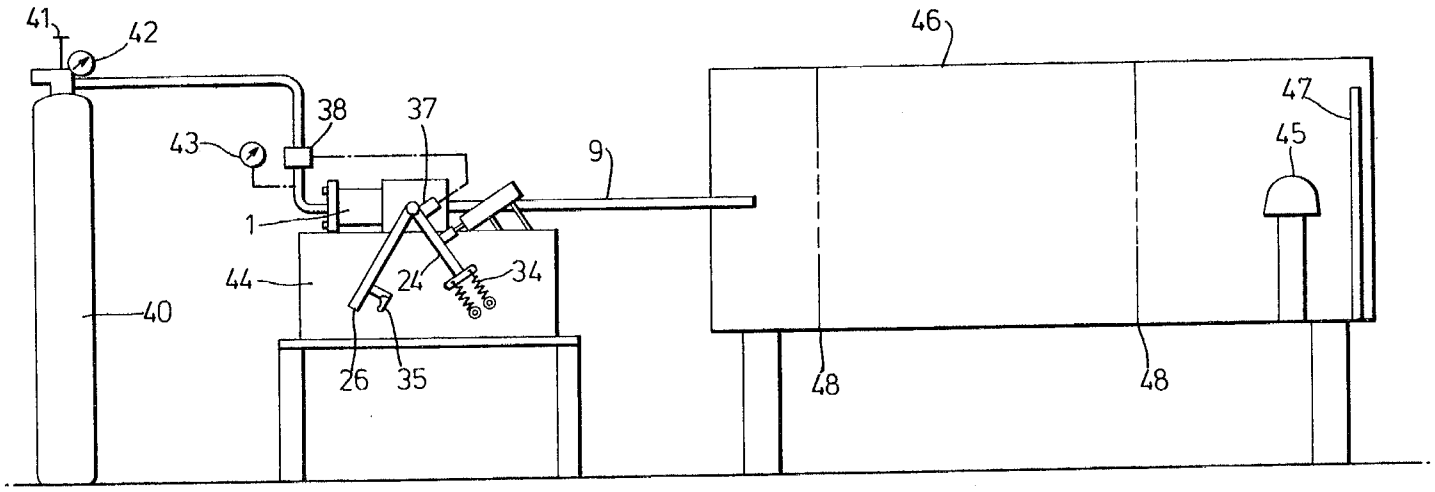
FIG. 3 shows the gun in its position on a firing range of this invention.

In FIG. 3 the compressed gas is contained in a gas cylinder 40 equipped with a pressure regulating valve 41 and an outlet pressure gauge 42. A further monitoring gauge 43 is positioned between the inlet valve 38 and charge chamber 1 of the gun. The gun is fixed on a wooden stand 44 and the barrel 9 points at a target 45 in a firing range 46. A back stop 47 of wood or similar energy absorbing material retains any projectiles that pass directly through the target 45. Photo cells 48 allow the velocity of the projectile, as it passes through the firing range 46, to be calculated.

In use, the gas regulator valve 41 is set to a pre-determined required pressure read from gauge 42. A projectile 18 and sabot 19 are inserted into the breech end of the barrel 9 which is then screwed into the socket in the rotary valve 6. The cocking lever 26 is taken forwards to engage the firing lever 24 which is then drawn back to the cocked position, closing the rotary valve 6 and causing the microswitch 37 to open the solenoid valve 38. When the gas monitoring valve 43 shows the required pressure (generally in less than 1 second) the trigger 35 is pulled allowing the firing lever 24 to fly forward under the influence of the springs 34 first operating the microswitch 37 to close the solenoid valve 38 and then immediately opening the rotary valve 6 to fire the gun. The cycle may then be repeated.

It will be apparent that other types of gas supply and other, preferably automatic, loading systems may be substituted for those shown, without departing from the scope of the invention.

The following examples illustrate the results achieved with the apparatus described above:

EXAMPLE 1

A charge chamber, of internal volume 200 cc, was filled, to a pressure of 700 psi, with helium. A reinforced plastics sabot, diameter of 7.62 mm, housing a metal projectile, weight 1 g, was placed at the breech end of a 660 mm long barrel, having a rifled bore of 7.62 mm diameter.

Under these condition when the gun was fired a projectile velocity of 300 meter/sec was obtained.

EXAMPLE 2

The conditions and apparatus of Example 1 were employed except that the pressure of helium in the charge chamber was increased to 1500 psi. Under these conditions the projectile velocity obtained was 460 meter/sec.

EXAMPLE 3

The conditions and apparatus of Example 2 were employed except that air replaced helium as the working gas. Under these conditions the projectile velocity obtained was 310 meter/sec.

EXAMPLE 4

A charge chamber, of internal volume 200 cc was filled to a pressure of 80 psi. A metal projectile of 6 mm diameter was placed at the breech end of a barrel having a plane bore of 6.5 mm diameter.

Under these conditions when the gun was fired a projectile velocity of between 100 and 120 meter/sec was obtained.

I claim:

1. A gas gun suitable for ballistic testing and operable to propel a projectile at a velocity between 100 and 1000 meters per second solely by the action of a noncombustible compressed gas, said gun having a charge chamber, an inlet valve to admit a charge of compressed noncombustible gas to the charge chamber, a barrel to receive a projectile, and an outlet valve located between said charge chamber and said barrel and adapted to be moved rapidly from a closed to an open position relative to said charge chamber and barrel to effect communication between the charge chamber and the breech end of the barrel for releasing the compressed noncombustible gas from said charge chamber to the breech end of said barrel to propel said projectile through and out of said barrel, said outlet valve being a rotary valve consisting of a frustoconical valve member, rotatable within a complementary seat, and having a radial bore extending therethrough in a direction transverse to the axis of rotation of said valve member for connecting together two parts in the wall of said seat respectively connected to said charge chamber and said breech end of the barrel, said radial bore being of tapered configuration and having its larger end disposed toward said charge chamber and its smaller end disposed adjacent the breech end of said barrel when said valve member is in its open position with the charge chamber in communication with the barrel via said bore, the larger end of said radial bore being the inlet end of said bore and complementing a first port in a part in the wall of the seat adjacent the charge chamber when said valve is in its said open position, and the smaller end of said radial bore being the outlet end of said bore and complementing a second port, smaller than said first port, in a part in the wall of the seat adjacent said breech end of the barrel when said valve is in its said open position.

2. A gas gun according to claim 1 wherein the inlet valve is linked to the rotary outlet valve so that the closing of the inlet valve immediately precedes the opening of the outlet valve.

3. A gas gun according to claim 2 wherein the inlet and rotary outlet valves are linked electronically.

4. A gas gun according to claim 1 wherein the inlet valve is a solenoid valve.

5. A gas gun according to claim 1 wherein the inlet valve and outlet valve are combined as a three way rotary valve.

6. A gas gun according to claim 1 including means for biasing the rotary outlet valve towards a position wherein the charge chamber is in communication with the barrel.

7. A gas gun according to claim 6 wherein the rotary outlet valve is so biassed by the action of one or more springs.

8. A gas gun according to claim 1 wherein the charge chamber is designed to withstand a gas pressure of between 100 and 2000 psi.

9. A gas gun according to claim 1 wherein the charge chamber is connected to a source of a compressed gas which is helium.

10. A firing range for ballistic testing of protective clothing comprising a gas gun according to claim 1, and means for measuring the velocity of a projectile fired from said gun and target support means.

11. A firing range according to claim 10 wherein the means for measuring the velocity of a projectile are photocells.

12. A gas gun according to claim 1 further comprising a means for applying pressure to the valve member, to keep the valve member in close fitting arrangement with the complementary seat, and thrust bearing means so arranged that pressure is applied to the valve member by the pressure applying means through said thrust bearing means.

13. A gas gun according to claim 12 wherein the said means for applying pressure to the valve member is adjustable to control the maximum spacing between the valve member and its complementary seat.

* * * * *